United States Patent [19]

Holzapfel et al.

[11] Patent Number: 4,728,015

[45] Date of Patent: Mar. 1, 1988

[54] GARMENT SHAPING SYSTEM

[75] Inventors: Michael Holzapfel, Buford, Ga.; Shannon Cooper, San Antonio, Tex.

[73] Assignee: Hotec Incorporated, Buford, Ga.

[21] Appl. No.: 559

[22] Filed: Jan. 5, 1987

[51] Int. Cl.[4] ..... D06F 71/18; D06F 71/40

[52] U.S. Cl. ..... 223/70

[58] Field of Search ..... 223/68, 69, 70, 57, 223/51, 73, 76, 79, 74; 38/1 B, 14, 20

[56] References Cited

U.S. PATENT DOCUMENTS

| | | | |
|---|---|---|---|
| 786,554 | 4/1905 | Earl et al. | 223/70 |
| 2,189,789 | 2/1940 | Frentzel | 223/70 |
| 2,429,047 | 10/1947 | Bowen | 223/70 |
| 2,454,977 | 11/1948 | Richa et al. | 223/70 |
| 2,841,315 | 7/1958 | Paris | 223/70 |
| 3,216,633 | 11/1965 | Paris | 223/70 |
| 3,737,080 | 6/1973 | Paris | 223/70 |
| 4,199,088 | 4/1980 | Sanko | 223/67 |

*Primary Examiner*—Louis K. Rimrodt

*Attorney, Agent, or Firm*—Thomas & Kennedy

[57] ABSTRACT

Mannequin 14 includes upper torso portion 15 and lower torso portion 16. Upper torso portion 15 moves vertically with respect to the lower torso portion, and both portions expand laterally to mechanically distend a garment placed about the mannequin. Steam and air are introduced into the mannequin and pass outwardly through the garment draped on the mannequin while the garment is distended both vertically and laterally.

14 Claims, 6 Drawing Figures

GARMENT SHAPING SYSTEM

FIELD OF THE INVENTION

This invention relates to the field of garment shaping whereby garments, such as shirts, blouses, sport jackets and suit coats and other garments that fit the upper torso of a human body are shaped, as by removing the wrinkles and folds from the garments after the initial manufacturing process has completed the construction of the garment. The process includes dispending the garment to its full lateral girth, and passing steam and air through the garment in its distended configuration, so that the steam tends to soften and relax the material of the garment while the garment is distended, thereby tending to remove the wrinkles, folds, etc. from the garment.

BACKGROUND OF THE INVENTION

When garments, such as shirts, jackets and other items that fit about the upper portion of the human body are to be pressed or otherwise to have the wrinkles, folds, etc. removed from the garment, one of the more common procedures is to expand the garment with air and/or steam so as to tend to lightly stretch the fabric of the garment, which tends to open the wrinkles, folds, etc. in the fabric, and the steam tends to soften or relax the material. After this step, dry cool air can be passed through the garment, causing the yarns to become fixed in their straightened configuration.

In the past, one of the common procedures for accomplishing the above described steps was to drape a garment about an inflatable porous bag and then introduce steam and air into the bag. This tends to inflate the bag out against the garment, thereby inflating the garment to its full girth, and the passage of steam through the material of the bag and then through the material of the garment accomplished the relaxing of the yarns, and the subsequent passage of cool dry air through the bag and the garment would tend to cause the yarns to assume the new, flat or "pressed" configuration.

While the above noted procedures have been successful and have been practiced for a long time, one of the problems is that the garments are distended primarily only laterally, with very little, if any, vertical distending occurring during the process. Further, the steam and air is required to pass through multiple layers of material, both the bag material and the material of the garment, with the bag material being inflated out in abutment with the garment material. This abutting relationship of the two materials tends to create a somewhat impervious barrier to the steam and air. This barrier to the flow of air and steam causes a low rate of movement of steam and air through the garment for a given steam and air pressure and requires too much time for each pressing cycle, or too much inflating pressure to be applied to the garments to reduce the cycle time. This tends to result in excessive lateral stretching of the garment, sometimes causing folds or wrinkles to appear in the garment during the steaming step and subsequent air supply step.

The application of primarily only lateral forces to the garment with steam and air inflation further tends to cause some garments to become enlarged laterally after the "pressing" procedures. However, if the garments were distended both laterally and vertically during the steaming and airing process, the garment would tend to more accurately hold its original shape during the process, resulting in substantially no change in configuration upon completion of the process.

SUMMARY OF THE INVENTION

Briefly described, the present invention comprises a garment shaping system whereby garments of the type to be worn about the upper torso portion of the human body are shaped and "pressed", in that the garment is distended to its full configuration both mechanically and pneumatically, in both lateral and vertical directions, thus causing the garment to assume its natural full shape, and steam and air are introduced in sequence into the garment and pass through the garment and tend to cause the yarns of the garment to relax, thereby releasing any wrinkles that might have been previously formed in the garment. The later movement of air through the garment tends to cool and dry the fabric, so that the fabric tends to remain in its vertically and laterally distended shape, substantially without wrinkles, folds, etc.

The garment shaping system includes a mannequin comprising lower and upper torso portions over which the garment is draped, with the neck and arm openings at the upper portion of the garment placed over the upper torso portion, and with the tails or skirt portions of the garment draped downwardly about the lower torso portion. The lower portion of the garment is clamped against the lower torso portion of the mannequin, and the lower torso portion is expanded laterally outwardly so as to distend the lower portion of the garment. The upper torso portion of the mannequin is moved upwardly with respect to the lower torso portion and the upper torso portion is expanded laterally outwardly. This tends to distend the upper torso portion of the garment upwardly and outwardly. Air is introduced into the mannequin throughout the process, tending to pneumatically distend the garment to its full expanded configuration, and steam is also introduced during a portion of the shaping cycle so as to relax the fabric during the process.

After the steam and air cycle has been completed, the lower and upper torso portions of the mannequin are retracted so that the garment can be easily lifted away from the mannequin.

Thus, it is an object of this invention to provide a garment shaping system, whereby a garment of the type that fits about the upper torso of a human is mechanically and pneumatically distended, both laterally and vertically, and steam and air are passed through the garment in its distended configuration so as to relax the fabric of the garment and then to dry and cool the fabric, to remove the wrinkles, folds, etc. from the garment and to properly shape the garment.

Another object of this invention is to provide apparatus for shaping garments of the type that fit about the upper torso of a human body, the apparatus including an expandable and retractable mannequin that mechanically fills the garment both laterally and vertically during the shaping process, as steam and air are passed through the garment fabric.

Another object of this invention is to provide a garment shaping apparatus that is easily operated by relatively unskilled labor, which is reliable in its function of mechanically expanding, both vertically and laterally, the garment placed thereon as steam and air are moved through the garment fabric.

Another object of this invention is to provide a garment shaping method which utilizes a minimum of steam in its shaping process, but which functions to expediently and properly shape garments both laterally and vertically.

Other objects, features and advantages of the present invention will become apparent upon reading the following specification, when taken in conjunction with the accompanying drawings.

DETAILED DESCRIPTION

Figure 1:
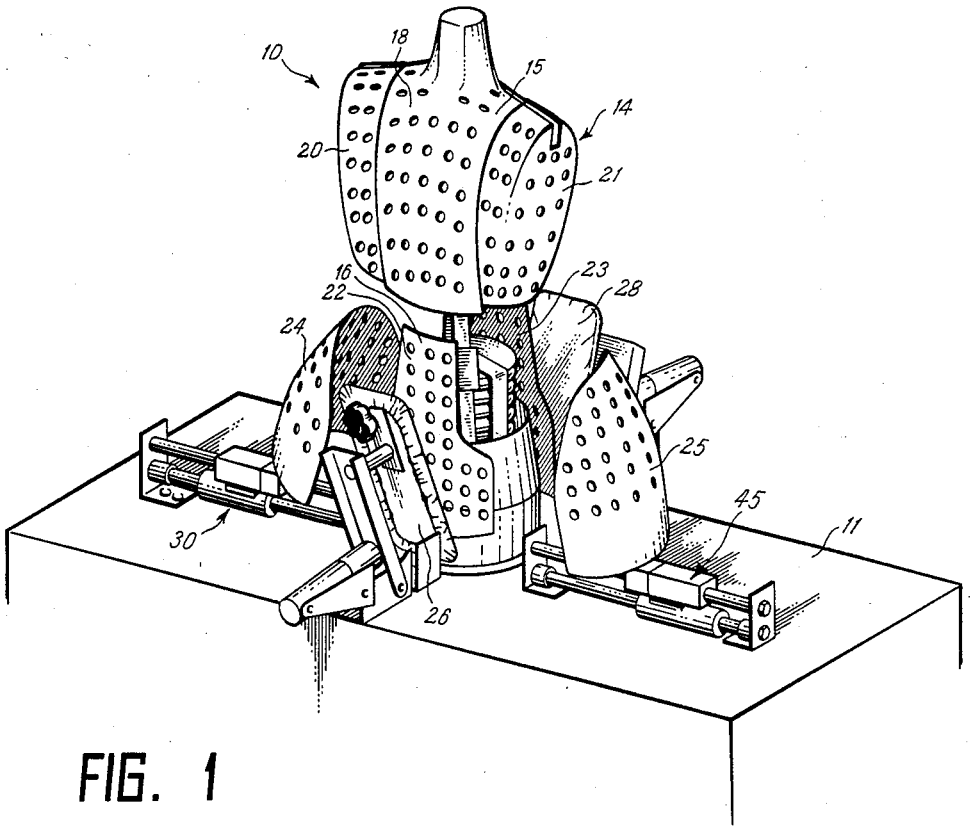
FIG. 1 is a perspective illustration of the garment shaping apparatus.

Referring now in more detail to the drawings, in which like numerals indicate like parts throughout the several views, FIG. 1 illustrates the garment shaping apparatus 10 which is mounted to a work table 11. The garment shaping apparatus includes a mannequin 14 having an upper torso portion 15 and a lower torso portion 16. The upper torso portion 15 includes breast plate 18 and back plate 19 (FIG. 3), and side plates 20 and 21. Lower torso portion 16 includes front and rear plates 22 and 23, and opposed hip plates 24 and 25. Presser pads 26 and 28 are mounted in facing relationship with respect to front and rear plates 22 and 23 and are arranged to oscillate toward and away from the front and rear plates, as described in more detail hereinafter.

Figure 2:
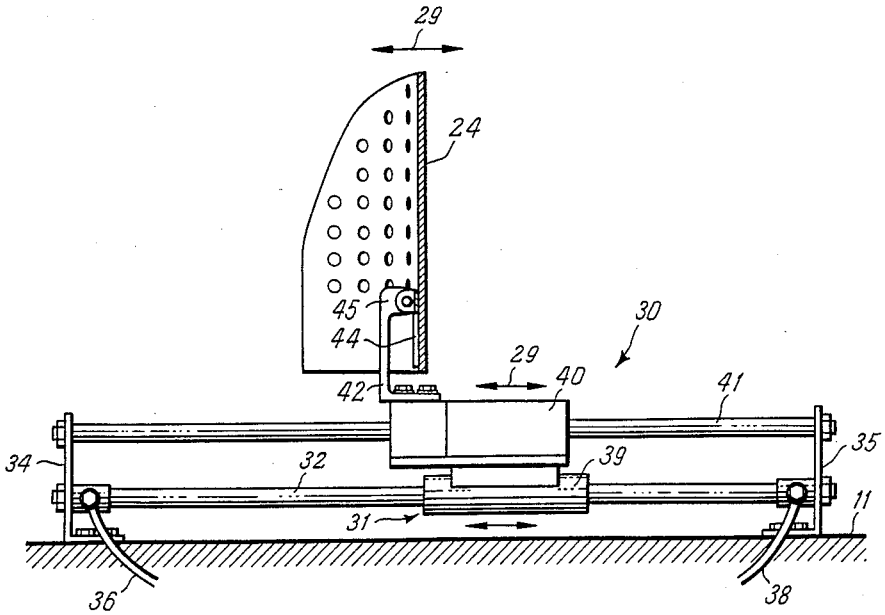
FIG. 2 is a front elevational view of one of the hip plates and its support system.

As illustrated in FIG. 2, hip plates, such as hip plate 24, are mounted on a lateral slide structure so that the hip plate can move laterally back and forth as indicated by the double headed arrow 29, toward and away from the other elements of the mannequin. Lateral slide 30 comprises a pneumatic/magnetic cylinder assembly 31 which includes elongated nonmetallic tube 32 mounted at its ends in brackets 34 and 35, with a magnet piston (not shown) located in and movable along the length of the elongated tube 32. Air supply and exhaust conduits 36 and 38 communicate with tube 32 at the ends of the tube, so as to urge the magnet piston along the length of the tube, as desired. An enlarged sleeve 39 surrounds tube 32 and is magnetically induced to follow the magnetic piston (not shown) that moves along the length of tube 32. Thus, when air pressure is applied through conduit 38 to one end of tube 32, the magnetic system is pushed to the other end of the tube, and sleeve 39 follows the movement of the piston. Likewise, when high pressure is communicated through the other conduit 36, the piston and its sleeve 39 move in the opposite direction.

Slide block 40 is rigidly connected to sleeve 39 and is arranged to slide along the length of slide rod 41. Slide rod 41 is also mounted at its end to brackets 34 and 35. Hip plate 24 is mounted to slide block 40 by means of upwardly extending bracket 42 and swivel bracket 44. With the swivel connection 45 joining brackets 42 and 44, hip plate 24 can pivot about a horizontal axis so as to tilt and conform to the shape of the garment being treated by the system.

While hip plate 24 and its lateral slide 30 have been described in detail, it will be understood that hip plate 25 and its lateral slide 45 are duplicates thereof.

Figure 3:
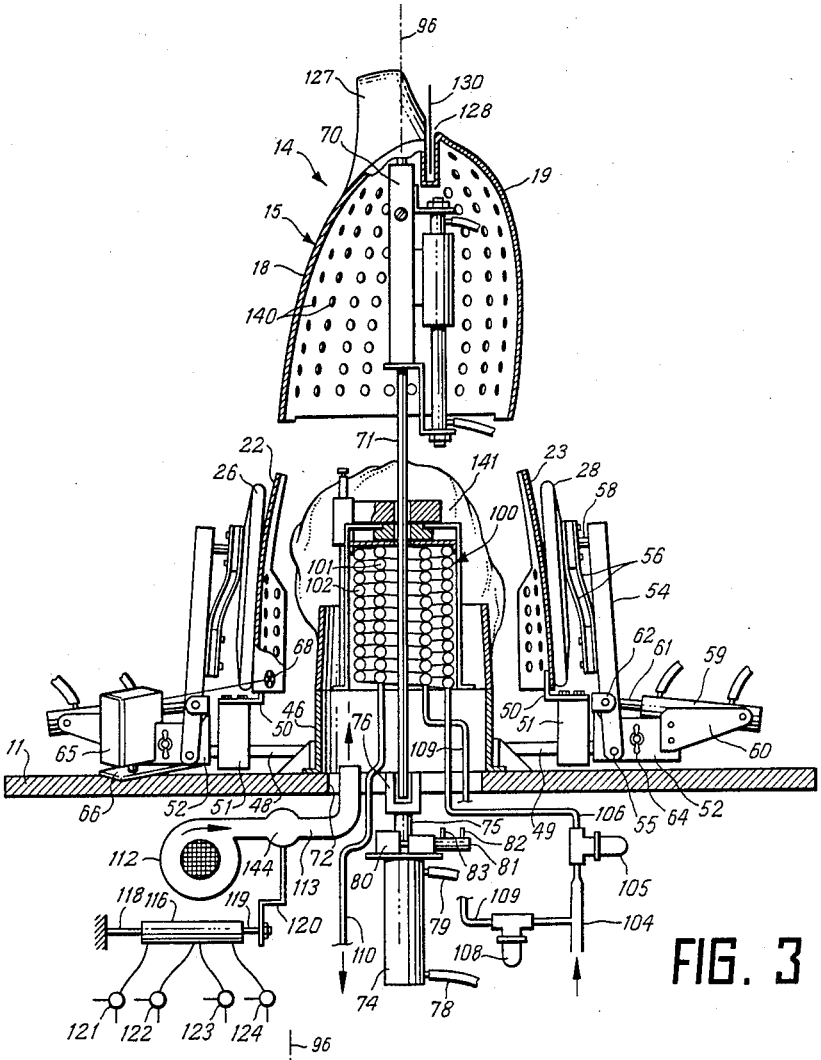
FIG. 3 is a side elevational view of the mannequin and its related components, with parts broken away to illustrate internal components.

As illustrated in FIG. 3, support base 46 is approximately cylindrical and is mounted to the upper surface of work table 11. Front and rear support rods 48 and 49 are mounted to opposite sides of support base 46 and extend horizontally outwardly from the support base. Each of the front and rear plates are mounted by means of an L-shaped bracket 50 onto mounting block 51, with the mounting block being telescopically mounted to its support rod 48 or 49. A set screw (not shown) can be used to hold the mounting block in place on its support rod.

Likewise, presser pads 26 and 28 are supported from the support rods 48 and 49. For example, rear presser pad 28 includes a support block 52 that is telescopically mounted to support rod 49, upwardly extending support lever 54 is pivoted at its lower end on pivot pin 55 which extends through the lever and through mounting block 52, and support pin 58 extends between the upper end portion of support lever 54 and presser pad 28, supporting the presser pad in place. Leaf springs 56 extend between lever 54 and the presser pad so as to maintain the presser pad in the proper orientation with respect to rear plate 23.

Pneumatic cylinder 59 is mounted by means of brackets 60 to support block 52, and the cylinder rod 61 is connected by clevis 62 to an intermediate portion of support lever 54, so as to urge the support lever 54 and its presser pad 28 toward and away from rear plate 23, in a manner to be described in more detail hereinafter. Set screw 64 is threaded into support block 52 so that the support block and its pressure pad 28 can be moved toward and away from the mannequin, as may be desired for proper adjustment of the equipment.

Presser pad 22 is supported in a similar manner on the opposite side of the mannequin. In addition, photoelectric cell 65 is supported by auxiliary support plate 66 from support block 52. A reflective spot 68 is mounted to the lower portion of front plate 22 and is arranged to reflect light to photoelectric cell 65. Thus, photoelectric cell 65 is capable of determining if the reflective spot 68 is covered by a garment or is left uncovered by the difference in reflective properties of the garment and of the reflective spot.

As further shown in FIG. 3, upper torso portion 15 of mannequin 14 includes an internal vertically extending support 70 which is connected by brackets (not shown) to breast plate 18 and back plate 19. The upper end portion of support rod 71 extends into internal support 70, and support rod 71 extends downwardly from the upper torso portion 15, through the lower torso portion 16, downwardly through an opening 72 in work table 11. Pneumatic lifting cylinder 74 is mounted beneath work table 11, and its cylinder rod 75 extends upwardly and a socket 76 is mounted to its end. Socket 76 receives the lower end portion of support rod 71 and supports the support rod 71 and upper torso portion 15 above lower torso portion 16, as illustrated. Fluid supply conduits 78 and 79 function to supply fluid under pressure to lifting cylinder 74, causing cylinder rod 75 to raise and lower, thereby lifting and lowering upper torso portion 15.

A brake 80 is mounted at the upper end of cylinder 74, and brake cylinder 81 is arranged to expand and contract the brake elements of brake 80. Conduits 82 and 83 supply fluid under pressure to brake cylinder 81 so as to actuate the brake elements. The brake elements clamp against cylinder rod 75 so as to hold the cylinder rod against vertical movement.

Figure 4:
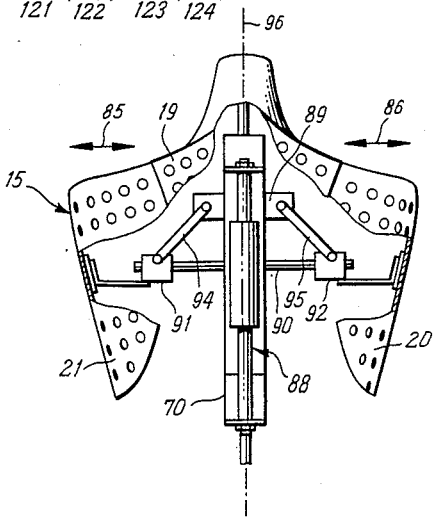
FIG. 4 is a rear elevational view of the upper torso portion of the mannequin, with portions broken away so as to illustrate the internal components.

As illustrated in FIG. 4, side plates 20 and 21 of upper torso portion 15 are movable laterally as indicated by the double headed arrows 85 and 86 with respect to breast plate 18 and back plate 19. A vertical slide assembly 88, similar to lateral slides 30 and 45 (FIGS. 1 and 2) is mounted to internal support 70, and slide block 89 is movable vertically in response to the vertical slide assembly. Horizontal slide bar 90 extends in both lateral directions from vertical slide assembly 88, and lateral slide blocks 91 and 92 are movable along the length of horizontal slide bar 90. Links 94 and 95 are each connected at one end to vertical slide block 89, and each link is connected at its other end to a lateral slide block 91 or 92. Fastening brackets 94 and 95 are connected between slide blocks 91 and 92 and side plates 20 and 21 of the upper torso portion of the mannequin. Thus, when the cylinder of vertical slide assembly 88 moves slide block 89 upwardly to draw the links 94 and 95 upwardly, the horizontal slide blocks 91 and 92 are drawn inwardly toward each other along the length of horizontal slide bar 90, thereby pulling the side plates 20 and 21 inwardly toward the vertical axis 96 of the mannequin. Likewise, when slide block 89 is moved downwardly by vertical slide assembly 88, links 94 and 95 will urge slide blocks 91 and 92 and their respective side plates 20 and 21 laterally outwardly away from the vertical axis 96.

A steam supply system 100 is mounted within mannequin 14 and comprises a pair of concentric steam coils 101 and 102 mounted about support rod 71, with the lower portions of the steam coils being surrounded by support base 46. A common steam supply conduit 104 carries steam to both copper steam coils 101 and 102 at a temperature between 250° and 300° F., with steam control valve 105 positioned in branch conduit 106, with the branch conduit 106 extending to outer steam coil 102. Likewise, a steam control valve 108 controls the flow of steam through branch conduit 109 to inner coil 101.

Outer steam coil 102 defines a plurality of small openings therein directed generally outwardly toward the mannequin 114, and the openings function to supply small droplets of steam within the confines of the mannequin. The inner steam coil 101 has an exhaust conduit 110 that communicates with a drain. When steam is to be supplied to the mannequin, the inner steam coil 101 functions as a heat source to continuously heat outer steam coil 102, and when the steam is to be introduced to the internal portion of the mannequin 14, steam is supplied to the outer steam coil 102 and a fine mist of steam is introduced into the space within the confines of the mannequin. With this arrangement, the continuous supply of steam to the inner coil tends to continuously heat the outer coil, so that when the steam is supplied on an intermitent basis to the outer coil, the outer coil will be hot and the steam will not tend to condense within the outer coil.

Blower 112 is positioned below work table 11 and its delivery conduit 113 extends upwardly through the opening 72 in the work table 11 and into the support base 46. Valve 114 in delivery conduit 113 controls the volume of air delivered by blower 112 to the mannequin. Valve control cylinder 116 is a multi-pistoned cylinder, with each piston rod 118 and 119 extending from opposite ends of cylinder 116. One rod 118 is attached at its distal end to part of the frame work of the assembly, while the other rod 119 is connected at its distal end to valve crank 120. Valve crank 120 controls the position of the valves 121, 122, 123 and 124 control the supply and exhaust of fluid to cylinder 116.

When both cylinder rods 118 and 119 are fully retracted, valve 114 is moved to its narrowest constriction so that blower 112 is capable of delivering only 25% of its full capacity to mannequin 14. However, when valves 123 and 124 are reversed and cylinder rod 119 fully distends, blower valve 114 opens an additional 25%, thereby providing a 50% output capacity for blower 112. However, should rod 119 be retracted and rod 118 be distended, valve 114 will permit 75% of the full capacity of blower air to enter the mannequin. Further, should both rods 118 and 119 be fully distended, valve 114 will permit 100% of the air to pass from blower 112 into the mannequin.

As illustrated in FIG. 3, upwardly facing hanger slot 128 is formed in back plate 19, with neck protrusion 127 being formed at the upper end of breast plate 18. Hanger slot 128 also extends into side plates 20 and 21, so that a hanger 130 can be conveniently supported in the hanger slot 128, with the hook upper end portion 130 of the hanger being juxtaposed the neck protrusion 127.

OPERATION

When the garment shaping apparatus is to be placed in use, steam will be supplied continuously to inner steam coil 101, so that the inner steam coil maintains the outer steam coil 102 at a suitable temperature, and the steam to be introduced to the system through the outer steam coil will not tend to rapidly condense.

Before the operator drapes a garment about the mannequin 14, the side plates 20 and 21 of the upper torso will be laterally retracted, the hip plates 24 and 25 of the lower torso portion will be laterally retracted, and the press pads 26 and 28 will be in their open or outwardly tilted attitudes.

Figure 5:
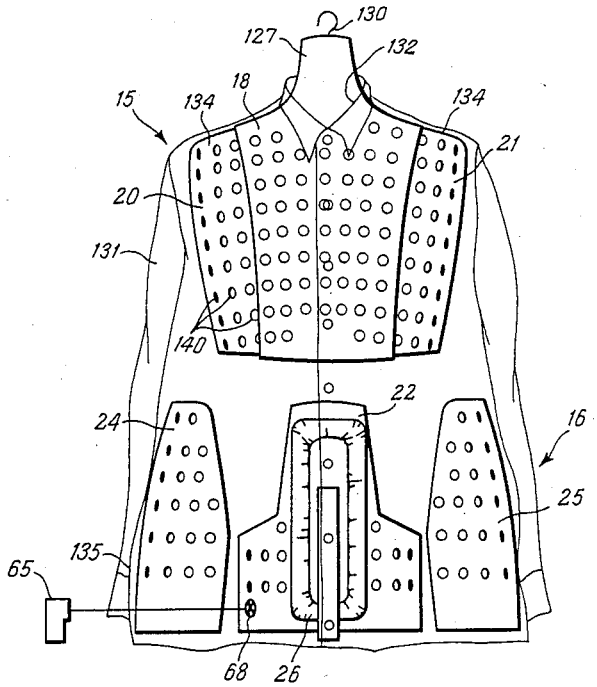
FIGS. 5 and 6 are progressive illustrations of the lower and upper torso of the mannequin, showing how the upper torso moves vertically and how the hip plates and side plates move laterally.

The worker then inserts a coat hanger 130 into the coat hanger slot 128 (FIG. 5), so that the hook portion of the coat hanger protrudes upwardly at the neck protrusion of the upper torso portion of the mannequin. The worker then drapes a garment 131 (FIGS. 5 and 6) downwardly over the upper torso portion of the mannequin, with the neck opening 132 of the garment extending about the neck protrusion 127 of the mannequin, and with the shoulder portions 134 of the garment extending over the upper surfaces of the breast plate and back plate 18 and 19 and over the upper portions of the side plates 20 and 21. The lower or tail portion of the garment is allowed to hang outside the front plate 22, rear plate 23 and hip plates 24 and 25 of the lower torso portion 16 of the mannequin.

Figure 6:
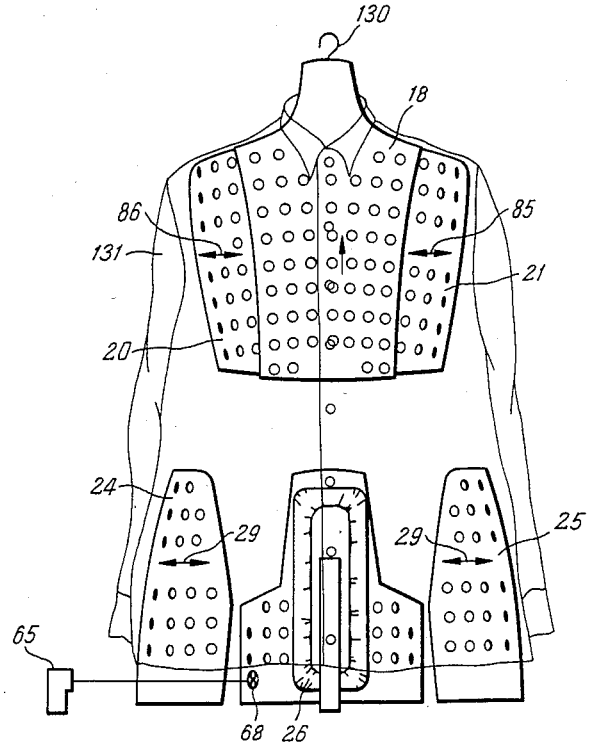

After the garment has been draped in this manner about the mannequin (FIG. 5), the operator actuates a foot switch (not shown) which starts the cycle of operation. Photocell 65 will detect darkness if the tail portion of the garment covers the reflective surface 68 which is located on one of the front or rear plates 22 or 23 of the lower torso portion. In response to seeing darkness, the control system (not shown) actuates pneumatic lifting cylinder 74, thereby raising upper torso portion 15 until photocell 65 receives a reflection from reflective surface 68. At this point the garment height and the height of the mannequin are matched and brake cylinder 81 (FIG. 3) grips cylinder rod 75, so as to hold the cylinder rod stationary and avoid further vertical movement of upper torso portion 15. Also, presser pads 26 and 28 pivot inwardly under the influence of their cylinders 59, so as to press against the front placket portion of the garment and against the back panel of the garment, clamping these portions of the garment against the front plate 22 and rear plate 23. After the clamping action of the presser pads 26 and 28 has been achieved, hip plates 24 and 25 are moved laterally outwardly so as to engage the inner surfaces of the lower portion of the garment, thereby laterally distending the lower portion of the garment (FIG. 6). In the meantime, blower 112 (FIG. 3) is energized and emits a stream of air upwardly into the confines of the mannequin and the garment draped thereon, thereby tending to inflate the garment.

As soon as the garment has been anchored at its lower end by presser pads 26 and 28 pressing the front and rear portions of the tail of the garment into contact with the front and rear plates 22 and 23, brake 80 is released by brake cylinder 81 (FIG. 3), and lifting cylinder 74 raises upper torso portion 15 of the mannequin. This tends to mechanically distend the garment upwardly to its full normal height. In the meantime, side plates 20 and 21 of the upper torso portion are moved laterally outwardly by vertical slide assembly 88 (FIG. 4), until the side plates engage the side portion of the garment, thereby tending to mechanically expand the garment in this area. The amount of air pressure supplied to lifting cylinder 74 and to the cylinder of vertical slide assembly 88 is adjustable and is controlled so as to bias the shoulder portion of the garment upwardly and outwardly with a gentle force that does not tend to wrinkle the garment. The upper portions of the side plates tend to support the shoulder portion of the garment.

When the garment has been mechanically expanded as described, steam valve 105 permits steam to be supplied to outer steam coil 102, and the small openings 140 along the length of the outer steam coil permit a mist of steam to be formed within the confines of the mannequin 14, and the steam and air tend to move outwardly of the mannequin and through the garment draped about the mannequin.

It will be noted that the outer surface elements of the mannequin, including the breast plate, back plate and side plates of the upper torso portion and the front plate, rear plate and hip plates of the lower torso portion are formed of sheet like material, with a network of openings formed through the sheet material. The openings permit the steam and air to rapidly pass through the sheet material of the mannequin so as to permeate and pass through the fabric of the garment.

Usually the blower 112 will operate continuously through each cycle of operation of the apparatus so that air is continuously introduced into the mannequin and into the garment draped on the mannequin. The steam is introduced into the mannequin only after the garment has been distended, thereby tending to relax the garment fabric when distended. The introduction of steam is terminated before the end of the cycle so that the air can cool and dry the fabric while the garment is still distended.

An air pervious bag 141 surrounds steam coils 101 and 102, with the lower opening of the bag telescoped about the support base 46, and with the upper opening of the bag telescoped about support rod 71. Bag 141 is inflatable in response to the supply of air and steam upwardly through support base 146, with the size of the bag being such that the bag inflates outwardly against the inner surfaces of front and rear plates 22 and 23 and hip plates 24 and 25. Bag 141 usually does not contact the garment draped about the mannequin 14, and the bag 141 tends to prevent water droplets generated from the steam stray from contacting the inner surfaces of the mannequin and the inner surfaces of the garment draped about the mannequin.

It thus is seen that apparatus for pressing garments is now provided that operates in a simple but versatile and reliable manner. It should be understood, however, that the apparatus just described in detail merely exemplifies principles of the invention in preferred forms. Many modifications may be made thereto without departure from the spirit and scope of the invention as set forth in the following claims.

We claim:

1. A method of removing wrinkles from a garment of the type worn about the upper body which includes neck and arm openings and an open lower portion comprising the steps of:

draping the garment downwardly about a mannequin, mechanically gripping and distending the lower portion of the garment outwardly, mechanically distending the garment upwardly, mechanically distending the upper portion of the garment outwardly, while the garment is distended outwardly and upwardly introducing steam and air within the garment in a volume sufficient to inflate the garment and sufficient for at least some of the steam to pass from within the garment outwardly through the garment, terminating the introduction of steam and continuing to introduce air within the garment in a volume sufficient for at least some of the air to pass from within the garment outwardly through the garment, and relieving the distending and inflation of the garment.

2. The method of claim 1 and wherein the garment is the type that has a front vertical opening, and wherein the step of mechanically gripping and distending the lower portion of the garment comprises overlapping the portions of the garment adjacent the front vertical opening and holding the overlapped portions together, then mechanically moving the lower portion of the garment outwardly.

3. The method of claim 2 and wherein the step of mechanically moving the lower portion of the garment outwardly comprises simultaneously moving plate members within the lower portion of the garment laterally away from each other until the plate members urge the lower portion of the garment outwardly.

4. The method of claim 1 and wherein the mannequin comprises an upper torso portion, and wherein the step of mechanically distending the garment upwardly comprises raising the upper torso portion until vertical tension is applied to the garment.

5. The method of claim 1 and wherein the mannequin comprises an upper torso, and wherein the step of mechanically distending the upper portion of the garment outwardly comprises expanding the upper torso of the mannequin in opposite lateral directions to laterally fill the garment.

6. The method of claim 1 and wherein the mannequin comprises an upper torso formed of telescopically arranged segments of sheet-like material and with the sheet-like material defining openings therethrough, and wherein the steps of introducing steam and air within the garment comprises passing steam and air from within the garment, through the openings of the upper torso and through the garment.

7. Apparatus for removing wrinkles from a garment of the type worn about the upper body which includes a neck and arm openings at its upper end portion and an open lower portion that surrounds the body comprising:

a mannequin comprising a lower torso portion and an upper torso portion which together generally form the shape of a human body, said lower torso portion including opposed front and rear support surfaces and opposed hip plates, means for moving said hip plates toward and away from each other, presser members movable toward and away from said support surfaces, said upper torso portion including a chest surface and an opposed back surface, and opposed side surfaces movable toward and away from each other, and means for moving said opposed side surfaces toward and away from each other, means for moving said upper torso portion vertically with respect to said lower torso portion, fluid supply means for introducing fluid into said mannequin, whereby a garment is draped about the mannequin, the presser members press the front and rear lower portion of the garment against the front and rear support surfaces, the hip plates are moved outwardly to urge the lower sides of the garment outwardly, the upper torso is moved upwardly, the opposed side surfaces of the upper torso portion are moved outwardly, and fluid is introduced inside the mannequin and passes outwardly through the garment.

8. The apparatus of claim 7 and wherein the opposed side surfaces of said upper torso portion are telescopically arranged in said chest surface and said back surface.

9. The apparatus of claim 7 and wherein said lower and upper torso portions are fabricated of sheet material which define a network of openings extending therethrough for the passage of fluid from within the mannequin outwardly through the garment draped about the mannequin.

10. The apparatus of claim 7 and wherein said upper torso portion includes an upwardly facing slot therein for receiving a coat hanger, whereby a coat hanger can be supported in the slot with its hook directed upwardly, a garment draped over the mannequin and the coat hanger with the hook of the coat hanger protruding through the neck opening of the garment, and the coat hanger lifted by its hook to lift the garment upwardly off the mannequin.

11. The apparatus of claim 7 and wherein said fluid supply means comprises a tubular copper coil positioned within said mannequin with nozzle openings formed about said coil, and means for supplying steam under pressure at a temperature in excess of 250° F. to said coil for uniformly dispersing steam within said mannequin.

12. Apparatus for removing wrinkles from a garment of the type worn about the upper body which includes a neck and arm opening at its upper portion and a lower open portion, comprising a mannequin including upper and lower torso portions over which the garment is draped, means for laterally expanding both the lower and upper torso portions of the mannequin, means for raising and lowering the upper torso portion with respect to the lower torso portion, and means for introducing steam and air into said mannequin in an amount to move outwardly through the garment draped about the mannequin.

13. The apparatus of claim 12 and wherein said upper and lower torso portions of said mannequin each define a network of openings therethrough for the movement therethrough of steam.

14. The apparatus of claim 12 and further including grip members movable toward and away from the lower torso portion of said mannequin to grip the lower portion of the garment against the lower torso portion of the mannequin.

* * * * *